US008147061B2

(12) United States Patent
Utsugi et al.

(10) Patent No.: US 8,147,061 B2
(45) Date of Patent: Apr. 3, 2012

(54) RECORDING APPARATUS

(75) Inventors: Yasushi Utsugi, Shiojiri (JP); Hiroto Miyauchi, Matsumoto (JP); Yutaka Matsui, Matsumoto (JP); Takashi Mizumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 377 days.

(21) Appl. No.: 12/500,332

(22) Filed: Jul. 9, 2009

(65) Prior Publication Data

US 2010/0007709 A1 Jan. 14, 2010

(30) Foreign Application Priority Data

Jul. 10, 2008 (JP) ..... 2008-180263

(51) Int. Cl.
*B41J 29/13* (2006.01)
*B41J 29/38* (2006.01)
*B41J 29/377* (2006.01)

(52) U.S. Cl. ..... 347/108; 347/17; 347/18

(58) Field of Classification Search ..... 347/108, 347/34, 29, 89, 17, 18, 84; 346/145
See application file for complete search history.

(56) References Cited

U.S. PATENT DOCUMENTS

| | | | | | |
|---|---|---|---|---|---|
| 3,962,608 | A * | 6/1976 | Forster et al. | 361/695 |
| 4,600,326 | A * | 7/1986 | Fudatsuji et al. | 400/691 |
| 5,056,331 | A * | 10/1991 | Lotz | 62/237 |
| 5,831,655 | A * | 11/1998 | Asawa et al. | 347/102 |
| 7,006,361 | B2 * | 2/2006 | Hosokawa et al. | 361/818 |
| 7,734,214 | B2 | 6/2010 | Masuda | |
| 2010/0200725 | A1 | 8/2010 | Masuda | |

FOREIGN PATENT DOCUMENTS

| | | | |
|---|---|---|---|
| CN | 1892458 | | 1/2007 |
| JP | 11153894 | A * | 6/1999 |
| JP | 2002023597 | A * | 1/2002 |
| JP | 2004-117589 | | 4/2004 |
| JP | 2004-142192 | | 5/2004 |

* cited by examiner

*Primary Examiner* — Stephen Meier
*Assistant Examiner* — Leonard S Liang
(74) *Attorney, Agent, or Firm* — Workman Nydegger

(57) ABSTRACT

A recording apparatus includes: a housing which constitutes an appearance of a recording apparatus body; and an electronic substrate which is vertically disposed along an inner side surface of the housing. Here, an air supply hole and an air exhaust hole are formed on a side surface portion of the housing corresponding to a lower portion and an upper portion of the electronic substrate so that an air-flow path for external air is formed in an installation region in which the electronic substrate is provided.

6 Claims, 6 Drawing Sheets

RECORDING APPARATUS

BACKGROUND

1. Technical Field

The present invention relates to a recording apparatus in which electronic substrates are vertically disposed along an inner side surface of a housing, and which can improve the radiation performance of the electronic substrates.

2. Related Art

In the following, an ink jet printer will be described as an example of the recording apparatus. Recently, advances have been made regarding the miniaturization of ink jet printers. In order to achieve the efficient use of space in the housing, printers in which the electronic substrates are vertically disposed along the inner side surface of the housing have made an appearance. In addition, thanks to this arrangement of the electronic substrates, the ink jet printer becomes easy to assemble. Since shield plates are provided in parallel with the electronic substrate for protection against magnetic force, the arrangement is also helpful in preventing the electronic substrate from being covered with the ink mist which is ejected from the recording heads and floats in the housing.

However, in such an arrangement of the electronic substrates, since the electronic substrates are disposed in a narrow space surrounded on every side, a countermeasure about the thermal radiation of the electronic components mounted on the electronic substrates becomes problematic. Further, the recording heads are manufactured at a high density and in many arrays, and operate at high speed. In addition, the apparatus is enhanced by the incorporation of numerous other functions such as those of facsimiles and scanners. In consideration of the circumstances, the countermeasure about the thermal radiation of the electronic components is an urgent problem.

In addition, in the following JP-A-2004-117589, an image forming apparatus in which opening portions are formed to discharge heat or vapor generated in the housing is disclosed. Further, in the following JP-A-2004-142192, the recording apparatus is disclosed in which the ventilation holes are formed in the side surfaces and the rear surface of the substrate box in order to prevent the attachment of paper dust to the electronic substrates.

However, it is impossible to effectively cool the heated electronic components and to radiate the heat only by providing the opening portions as disclosed in JP-A-2004-117589 or the ventilation holes as disclosed in JP-A-2004-142192. On the other hand, when a number of ventilation holes are disposed in the opening portions, it can be expected that the thermal effect will be improved. However, this causes deterioration in the moldability, appearance, and mechanical strength of the housing. In addition, it is conceivable that cooling fans could also be used in conjunction with the above, but that would cause the component cost and the power consumption to increase and the countermeasure of noise caused by the cooling fans would also be problematic.

SUMMARY

An advantage of some aspects of the invention is to provide a recording apparatus in which the electronic substrates are vertically disposed along an inner side surface of the housing which can improve the radiation performance of the electronic substrates.

According to a first aspect of the invention, there is provided a recording apparatus including: a housing which constitutes an appearance of a recording apparatus body; and an electronic substrate which is vertically disposed along an inner side surface of the housing. Here, an air supply hole and an air exhaust hole are formed on a side surface portion of the housing corresponding to a lower portion and an upper portion of the electronic substrate so that an air-flow path for external air is formed in an installation region in which the electronic substrate is provided. Here, strictly speaking, the term "vertical" in the phrase "vertically disposed" does not need to mean a vertical direction described in the invention. The term is also used to mean that the electronic substrate is inclined to some degree.

According to the aspect, the recording apparatus is simply configured such that the air supply holes and the air exhaust holes are formed in the side part of the lower portion and the upper portion in the side surface portion of the housing, which correspond to the lower portion and the upper portion of the electronic substrate. Therefore, the external air flows from the air supply holes into the installation region of the electronic substrate, so that the air comes into contact with the heated electronic components to be cooled, and then the air is warmed up to help the thermal radiation. The air warmed in the installation region flows through the air-flow path, and is then discharged from the air exhaust holes to the outside of the housing. Accordingly, it is possible to prevent the electronic substrate in the installation region from rising in temperature. In addition, by employing the air supply holes and the air exhaust holes, each of which has a small diameter and a large arrangement pitch, it is possible to prevent the mechanical strength of the housing from deteriorating.

According to a second aspect of the invention, in the reading apparatus according to the first aspect, a recording execution region used by a recording head is provided in a region disposed on a side of the installation region in the housing, and a shield member is provided in a boundary between the installation region and the recording execution region to protect the electronic substrate. The lower regions of the installation region and the recording execution region are partitioned by the shield member.

According to the aspect, since the lower regions of both the installation region of the electronic substrate and the recording execution region are partitioned by the shield member, no air current flows from the recording execution region into the lower region of the electronic substrate. Accordingly, the external air flows easily from the air supply holes which are formed on the lower side surface of the housing corresponding to the lower portion of the electronic components. In addition, the flow of air from the lower air supply holes to the upper air exhaust holes is stable.

According to a third aspect of the invention, in the reading apparatus according to the second aspect, a communication space is provided above the shield member so that the upper regions of the installation region and the recording execution region are connected for communication.

According to the aspect, the ink mist generated in the recording execution region of the recording head passes through the communication space provided above the shield member without being attached to the electronic substrate. Accordingly, it is possible to discharge the ink mist from the air exhaust holes provided on the upper portion to the outside together with the air flowing in the installation region.

According to a fourth aspect of the invention, in the reading apparatus according to any one of the first to third aspects, the air supply holes are formed on a lower corner portion of the housing formed so as to extend from the side surface portion to the bottom surface portion of the housing.

According to this aspect, since the air supply holes are formed in the lower corner portion of the housing extending from the side surface portion to the bottom side portion of the housing, the external air is accelerated to flow into the installation region from the air supply holes. Accordingly, the flow of air from the air supply holes formed on the lower portion in the installation region to the air exhaust holes formed on the upper portion is stabilized. In addition, since the volume of the air flow increases, the cooling operation for the electronic components is improved.

According to a fifth aspect of the invention, in the reading apparatus according to any one of the first to fourth aspects, the air supply hole and the air exhaust hole are formed in a slit shape which extends in the vertical direction of the housing.

According to this aspect, since the air supply holes and the air exhaust holes have a slit shape which is formed to be long in the vertical direction of the housing, it is possible to smoothly create the flow of air in the installation region of the electronic substrate without reducing the mechanical strength of the housing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the recording apparatus according to this embodiment of the invention will be described in detail with reference to the accompanying drawings. First, the ink jet printer 1 is employed as the best mode for carrying out the recording apparatus according to this embodiment of the invention, and the outline of the entire configuration thereof will be described on the basis of the drawings.

Figure 1:
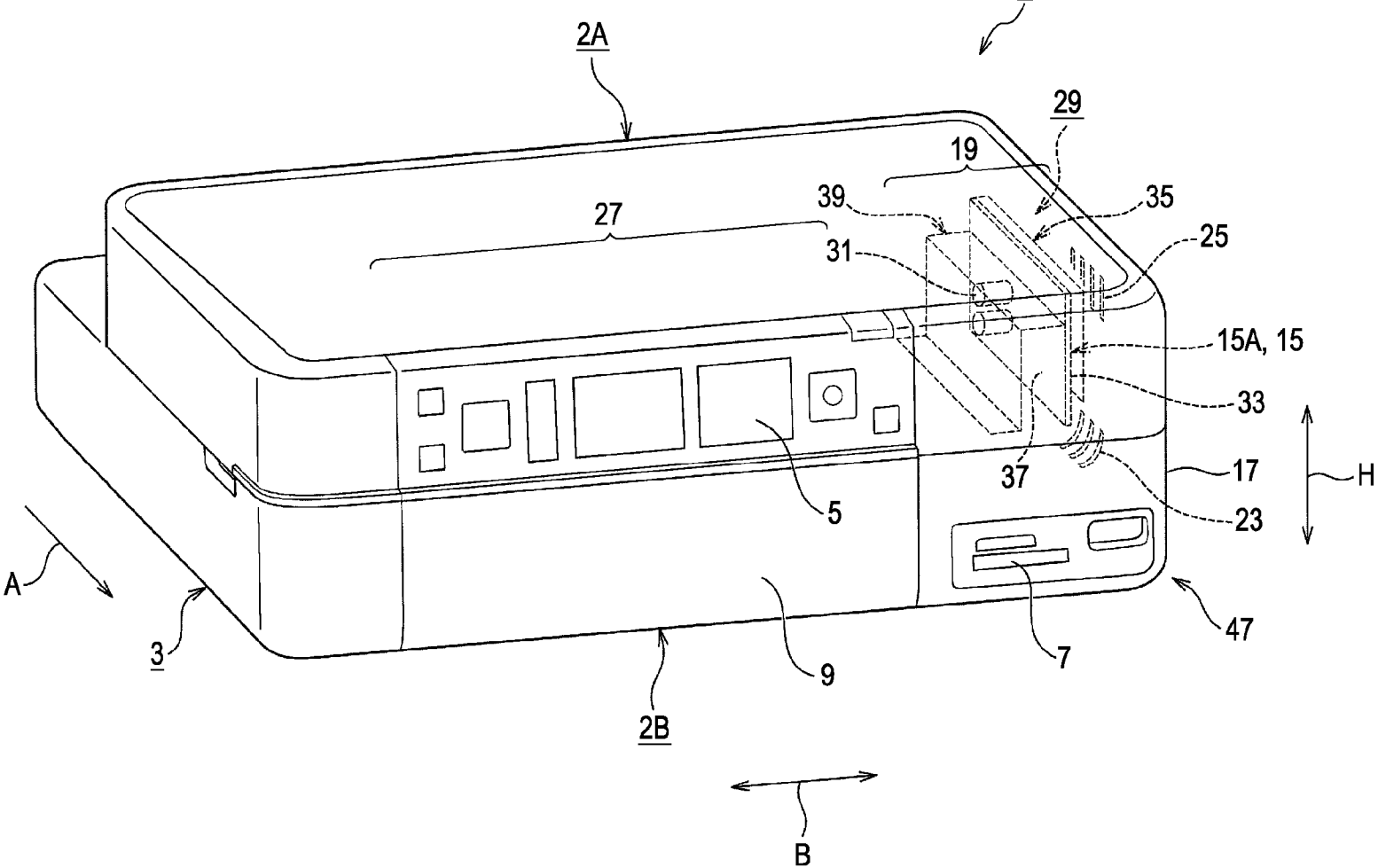
FIG. 1 is a perspective view illustrating an appearance of the ink jet printer and a part of an internal structure thereof according to the invention.

FIG. 1 is a perspective view illustrating an appearance of the ink jet printer and a part of the internal structure thereof according to the invention.

The ink jet printer 1 is a so-called multifunction machine which is provided with a scanner 2A on the upper portion thereof and a printer unit 2B on the lower portion thereof. The ink jet printer 1 is provided with a housing 3 which is a member constituting the appearance of the recording apparatus body. The appearance of the recording apparatus body has a rectangular housing shape which has a relatively flat surface. In the front surface of the housing 3, an operation panel 5 is provided to input the operation commands and setting options required for the execution of the various operations. Further, a media inserting port 7 is provided to insert an external media such as a memory card. In addition, a discharging stacker 9 of a rotary type (illustrated in a closed state in the drawing) is provided to stack a recording material to be subjected to recording execution.

In the housing 3, a transporting system (not shown) is provided to feed, transport, and discharge the recording material set on a mount surface. A recording execution system is provided which includes a recording head 11 (see FIG. 5 to be described later) which ejects various colors of ink onto the recording surface of the recording material supplied to the recording execution region and a carriage 13 which has the recording head 11 on the bottom surface thereof and moves back and forth in a width direction B across a transport direction A of the recording material. A control system is provided which includes an electronic substrate 15 for controlling the operation of the transporting system and the recording execution system on the basis of information input from the operation panel 5.

First Embodiment

Next, characteristic configurations of the recording apparatus according to this embodiment which is applied to the housing 3 of the ink jet printer 1 configured as described above will be described in detail.

Figure 2:
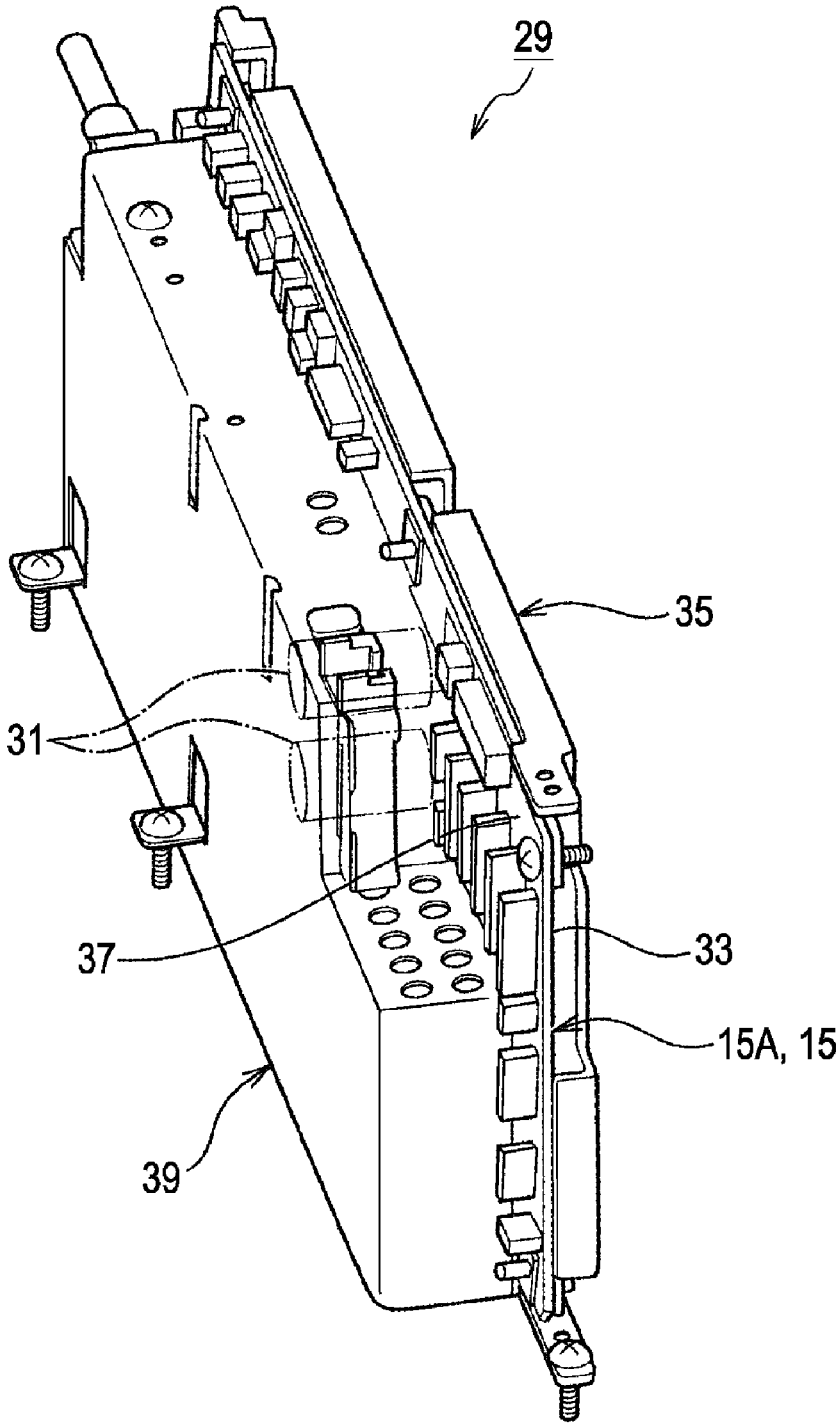
FIG. 2 is a perspective view illustrating a main substrate unit in a state where a shield member is mounted thereon.
Figure 3:
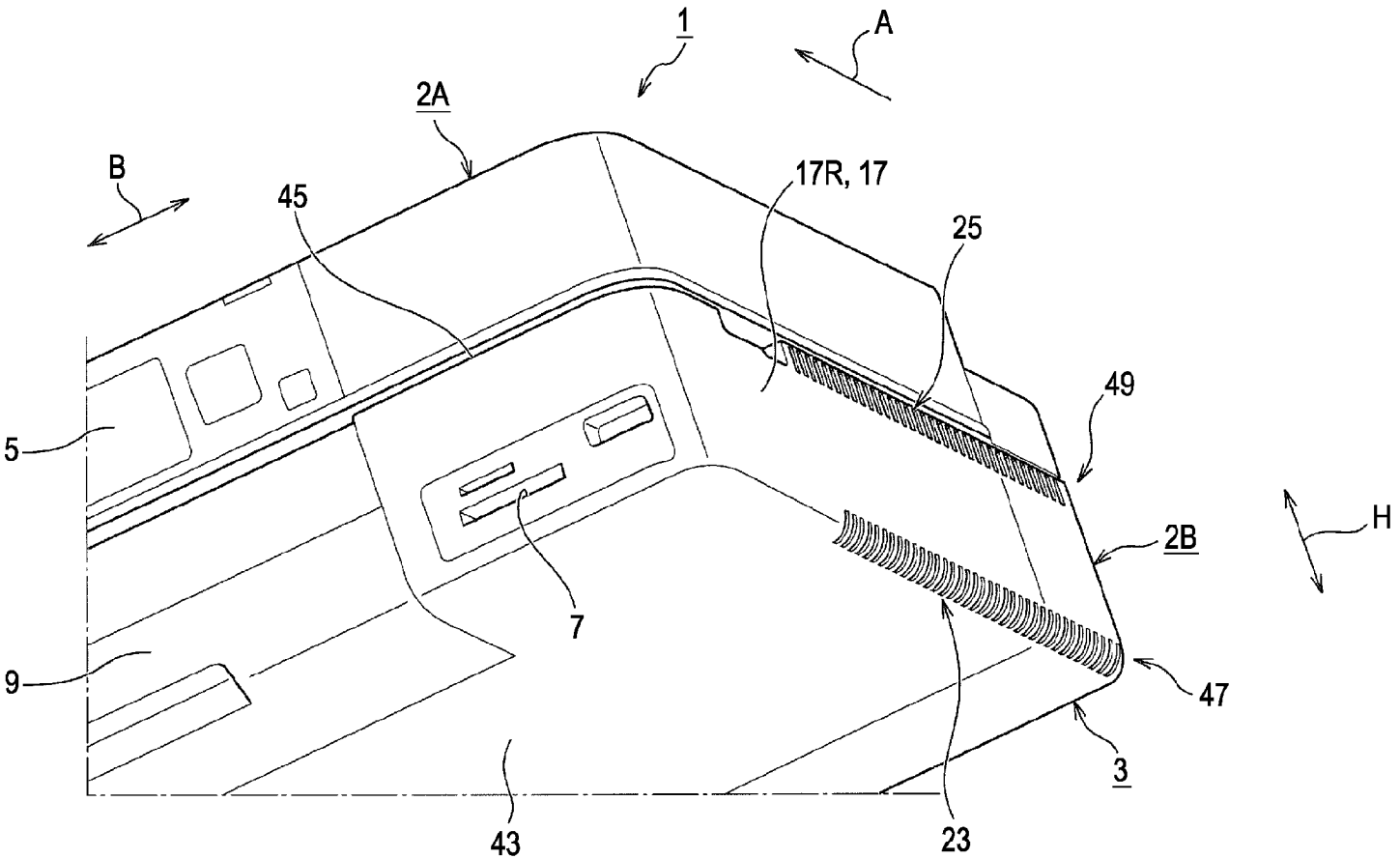
FIG. 3 is a perspective view illustrating a right sidewall portion as viewed from the oblique downside at the front of a housing.
Figure 4:
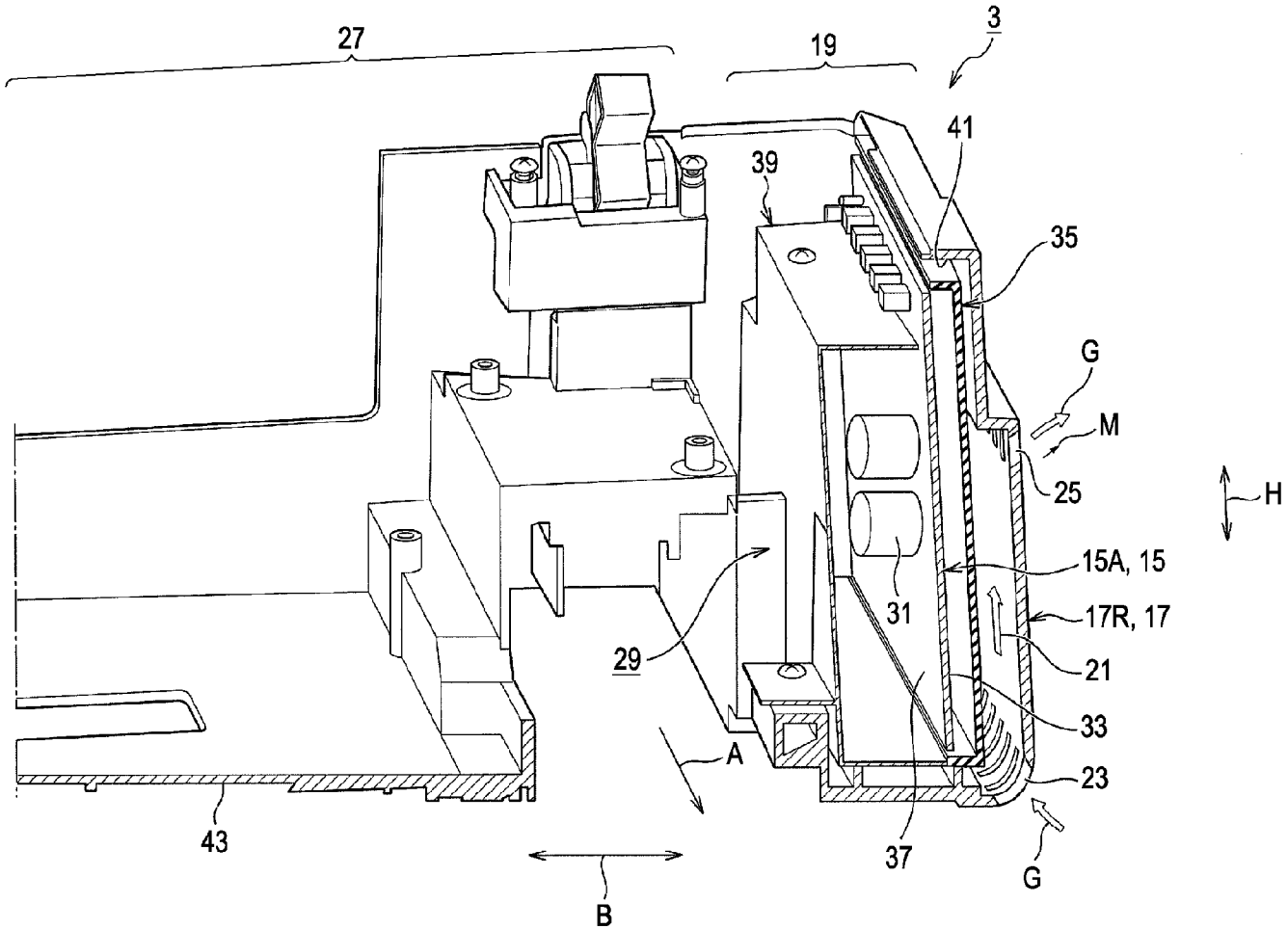
FIG. 4 is a perspective sectional view longitudinally illustrating a part of an internal space of a housing as viewed from the oblique upside at the front of the housing.
Figure 5:
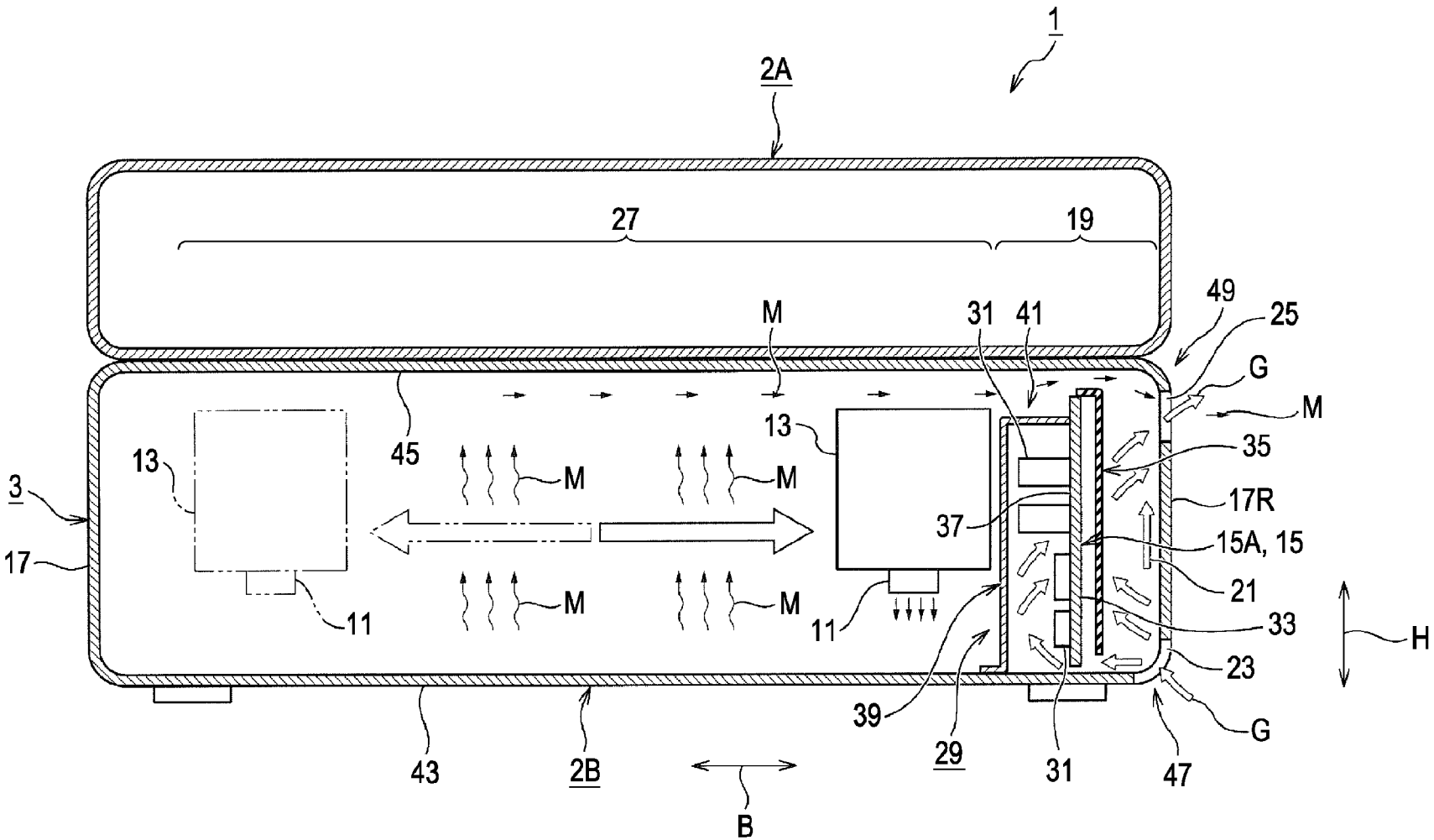
FIG. 5 is a front view schematically illustrating an internal space of a housing and a flow of ink mist and air.

FIG. 2 is a perspective view illustrating a main substrate unit in a state where the shield member is mounted on the electronic substrate which is the main substrate FIG. 3 is a perspective view illustrating a right side surface portion as viewed from the oblique downside at the front of the housing. FIG. 4 is a perspective sectional view longitudinally illustrating a part of an internal space of the housing as viewed from the oblique upside at the front of the housing. FIG. 5 is a front view schematically illustrating the configuration of the internal space of the housing and a flow of ink mist and air in the housing.

The recording apparatus 1 according to this embodiment includes the electronic substrate 15 in then housing 3, which is the member constituting the appearance of the recording apparatus body described above, such that the electronic substrate 15 is vertically disposed along the inner side surface of the housing 3. The installation region 19 in which the electronic substrate 15 is disposed is provided close to a peripheral wall portion 17 which is the side surface portion of the housing 3. The peripheral wall portion 17 corresponds to the lower portion and the upper portion of the electronic substrate 15. The air supply holes 23 and the air exhaust holes 25 are formed in the peripheral wall portion 17, and together form the air-flow path 21 for the external air G in the installation region 19.

As shown in FIGS. 3 to 5, in this embodiment, a number of the air supply holes 23 and the air exhaust holes 25 are provided in the surface portion 17R disposed on the right side of the housing 3 so as to be arranged at a predetermined interval along the transport direction A. In addition, the recording execution region 27 of the recording head 11 is provided in the lateral region disposed on the left side of the installation region 19 in the housing 3 so as to serve as a space for the carriage 13 to move back and forth.

A main substrate unit 29 is vertically provided in the installation region 19 along the vertical direction H of the housing 3. The main substrate unit 29 includes a main substrate 15A as an example of the electronic substrate 15. As shown in FIG. 2, the main substrate unit 29 is provided with the above-mentioned main substrate 15A on which the electronic components 31 are mounted to control the main operations of the ink jet printer 1. Further, an insulating cover 35 is provided by soldering to the main substrate 15A in order to maintain the insulating property by covering a soldered pattern surface 33 disposed on the right side of the main substrate 15. In addition, a shield member 39 is provided which covers the mounting surface 37 on which the electronic components 31 of the main substrate 15A are mounted, and here the mounting surface 37 is disposed on the left side of the main substrate 15A. The shield member 39 serves to protect the electronic components 31 against the magnetic force which could potentially have an electrically adverse effect on the operations thereof.

The shield member 39 is disposed on a boundary portion between the installation region 19 and the recording execution region 27. The lower regions of the installation region 19 and the recording execution region 27 are partitioned (to be in a closed state) by the shield member 39. Then, the lower region is in a state where the air G and the ink mist M in the housing 3 cannot come and go freely between the installation region 19 and the recording execution region 27. That is, no air current flows from the recording execution region 27 into the lower region of the electronic substrate 15A. Accordingly, the external air is flows easily from the air supply holes 23 which are formed on the lower side surface of the housing 3 corresponding to the lower portion of the electronic components 15A. In addition, the flow of air from the lower air supply holes 23 to the upper air exhaust holes 25 is stable.

On the other hand, a communication space 41 is formed above the shield member 39 such that the upper regions of the installation region 19 and the recording execution region 27 are connected for communication. In the installation region, the ink mist M which is generated in the recording execution region 27 and floats through the communication space 41 combines with the air G flowing in the installation region 19, and is then discharged from the air exhaust holes 25 to the outside of the housing 3.

The air supply holes 23 and the air exhaust holes 25 are formed in a slit shape which includes the elongated rectangle holes or the elongated ellipsoidal holes extending in the vertical direction H of the housing 3. Specifically, a number of the air supply holes 23 and a number of the air exhaust holes 25 are provided as shown in FIG. 3, and are disposed in an aligned state along the transport direction A.

In addition, the peripheral wall portion 17 and the side wall portion 17R of the housing 3 employed in this specification are not limited only to the portions covering the side surface of the recording apparatus body, but may refer to a range including the peripheral wall portion 17, the bottom plate portion 43 formed contiguously with the side wall portion 17R, the lower corner portion 47 connected to the top plate portion 45, and the upper corner portion 49. Then, in this embodiment, the air supply holes 23 provided in the lower portion of the housing 3 are formed in the lower corner portion 47 which extends over the side wall portion 17R and the bottom plate portion 43 of the housing 3.

Next, in the recording apparatus 1 of the embodiment configured in this way, (1) the cooling operation for the electronic substrate using the external air G and (2) the discharging operation for the ink mist will be described.

(1) Cooling Operation for Electronic Substrate (see FIG. 4)

The external air G flows from the air supply holes 23 formed in the lower corner portion 47 of the housing 3 into the installation region 19. The external air G cools the electronic components 31 by indirectly acting on the main substrate 15A via the pattern surface 33 formed on the rear surface side of the main substrate 15A. In addition, the external air G cools the electronic components 31 by directly acting on the main substrate 15A by passing underneath the main substrate 15A and flowing to the surface side of the main substrate 15A.

The air G used for cooling the electronic components 31 flows to the upper portion through the air-flow path 21 which is formed in a vertical direction in the installation region 19. Then, the air G is discharged from the air exhaust holes 25 formed on the upper portion of the side wall portion 17R of the housing 3 to the outside of the housing 3. Subsequently, the air G repeats the same operation until the temperature of the electronic components 31 is reduced to a predetermined temperature.

(2) Discharging Operation for Ink Mist (see FIG. 5)

In the recording execution region 27 formed in the housing 3, as the ink is ejected from the recording head 11, a part of the ink not used in recording becomes the floating ink mist M. In this embodiment, with the communication space 41, the ink mist M drifting in the upper region of the recording execution region 27 is drawn by the flow of the air G flowing in the installation region 19 through the air-flow path 21. Then, the ink mist M flows into the upper region of the installation region 19 to combine with the air G, and be discharged from the air exhaust holes 25 to the outside of the housing 3.

Second Embodiment

The recording apparatus according to the invention basically has the configuration described above. However, it is matter of course that the configuration can be partially changed or have a part thereof omitted without departing from the gist of the invention.

Figure 6:
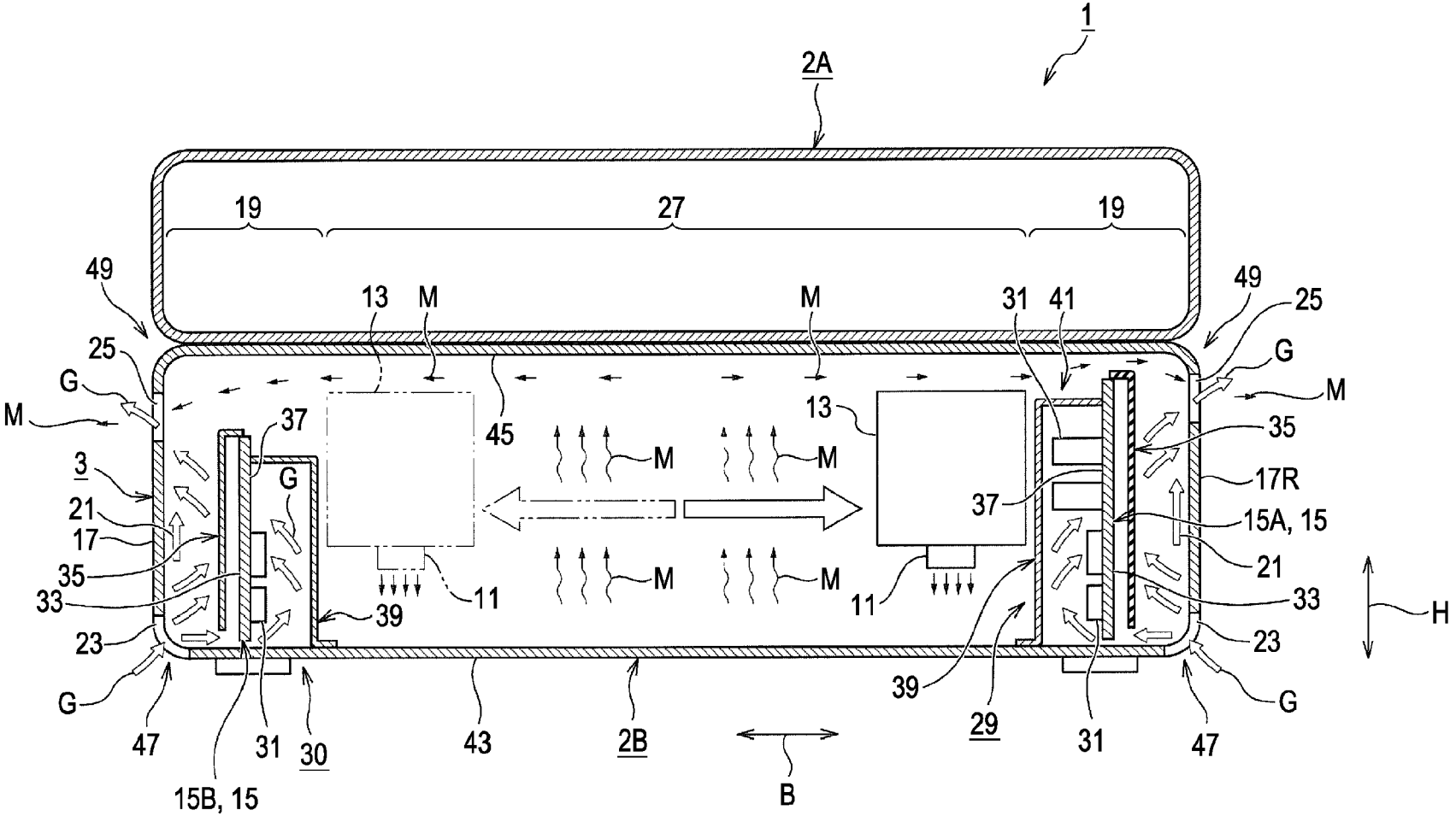
FIG. 6 is a front view schematically illustrating another embodiment in which plural pairs of an air supply hole and an air exhaust hole are arranged.

For example, as in the embodiment shown in FIGS. 1 to 5, the portions of the housing 3 where the air supply holes 23 and the air exhaust holes 25 are provided are not limited to the side wall portion 17R on the right side of the housing 3, but may be the side wall portion 17L on the left side of the housing 3 or another peripheral wall portion 17 such as the portion on the back surface side. In addition, as shown in FIG. 6, when plural electronic substrates 15 are provided and the air supply holes 23 and the air exhaust holes 25 are vertically disposed along the inner side surface of the housing 3 in different portions to each other, plural groups of the air supply holes 23 and the air exhaust holes 25 may be provided in the peripheral wall portion 17 of the housing 3. In this regard, the electronic substrate 15 disposed on the left side in FIG. 6 is illustrated as a sub substrate unit 30 which includes the sub substrate 15B, the insulating cover 35, and the shield member 39.

What is claimed is:

1. A recording apparatus comprising:

a housing which constitutes an appearance of a recording apparatus body; and an electronic substrate which is vertically disposed along an inner side surface of the housing, wherein an air supply hole and an air exhaust hole are formed on a side surface portion of the housing corresponding to a lower portion and an upper portion of the electronic substrate so that an air-flow path for external air is formed in an installation region in which the electronic substrate is provided, wherein a recording execution region used by a recording head is provided in a region disposed on a side of the installation region in the housing, and a shield member is provided in a boundary between the installation region and the recording execution region to protect the electronic substrate, and wherein the lower regions of the installation region and the recording execution region are partitioned by the shield member.

2. The recording apparatus according to claim 1, wherein a communication space is provided above the shield member so that the upper regions of the installation region and the recording execution region are connected for communication.

3. The recording apparatus according to claim 1, wherein the air supply hole is formed on a lower corner portion of the housing which is formed so as to extend from the side surface portion to the bottom surface portion of the housing.

4. The recording apparatus according to claim 1, wherein the air supply hole and the air exhaust hole are formed in a slit shape which extends in a vertical direction of the housing.

5. The recording apparatus according to claim 1, wherein there is a space under the electric substrate.

6. The recording apparatus according to claim 1, wherein electric components are mounted on the electric substrate ipsilateral to the shield member.

* * * * *